US005289917A

United States Patent [19]

Chabria

[11] Patent Number: 5,289,917

[45] Date of Patent: Mar. 1, 1994

[54] COMBINED GREETING CARD AND FLASHLIGHT GIFT PACKAGE

[75] Inventor: Paul R. Chabria, Wayne, Ill.

[73] Assignee: Press-A-Lite, West Chicago, Ill.

[21] Appl. No.: 43,035

[22] Filed: Apr. 5, 1993

[51] Int. Cl.[5] ..... B65D 69/00

[52] U.S. Cl. ..... 206/232; 206/461; 206/462; 206/482

[58] Field of Search ..... 206/232, 461, 462, 482, 206/486, 487; 229/92.8

[56] References Cited

U.S. PATENT DOCUMENTS

| | | | |
|---|---|---|---|
| 1,143,729 | 6/1915 | Schmidt | 229/92.8 |
| 2,344,437 | 3/1944 | Lande . | |
| 2,646,876 | 7/1953 | Sparks | 229/92.8 |
| 2,799,391 | 7/1957 | Eisner | 206/232 |
| 4,607,747 | 8/1986 | Steiner | 206/232 |
| 4,711,348 | 12/1987 | Schluger | 206/232 |
| 4,828,105 | 5/1989 | Silengo et al. | 206/232 |
| 4,840,275 | 6/1989 | Faiola et al. | 206/462 |
| 4,951,404 | 8/1990 | Lithwick | 206/462 |
| 5,096,058 | 3/1992 | Juravin et al. | 206/232 |

*Primary Examiner*—David T. Fidei

*Attorney, Agent, or Firm*—Lee, Mann, Smith, McWilliams, Sweeney & Ohlson

[57] ABSTRACT

A gift package containing a flashlight of the type that can be activated by pressing upon the front thereof is combined with a greeting card to provide an enhanced greeting. The combined unit is formed from a unitary blank die cut and scored for folding into a gift package on one side of a hinge fold and greeting card on the other side. A thermoformed gift holder may be arranged within the gift package for display of the gift through a framed window. The gift package gift therein may be arranged and displayed to constitute part of the greeting.

7 Claims, 2 Drawing Sheets

COMBINED GREETING CARD AND FLASHLIGHT GIFT PACKAGE

BACKGROUND AND SUMMARY OF THE INVENTION

For birthday, Christmas, valentine, etc., greetings, the sender frequently wishes to present a gift as well as the greeting card. In such cases, it is most effective, and therefore desirable, that the gift be received concurrently with the greeting card. The object of the present invention is to provide an inexpensive but attractive combined greeting card and gift package. Depending upon the nature of the gift, the card greeting and gift may be designed to provide a significant interrelationship so that the gift is not merely an unrelated article but an important part of the greeting. A gift which may become a part of the greeting will be described by way of an example of the highest and best use of the invention. Specifically, the well-known small flashlight which is activated by pressure applied to the sides is shown in the attached drawings for use in a design appropriate for a birthday, valentine or similar greeting.

Prior art U.S. Pat. Nos. 1,143,729, 2,344,437 and 4,840,275 disclose combined greeting cards and packages but do not disclose the combination of the invention herein which is designed specially to present as the gift a flashlight of the type that is generally flat in form and is activated by pressure applied to the front side thereof. The curved exposed surface of the plastic bubble enhances the appearance of the flashlight gift and creates an active package in that the flashlight may be activated by pressing the bubble. This possibility is especially a feature of the combination shown in FIGS. 7, 8 and 9 of the drawings wherein indicia, e.g., the word "VALENTINE", is inscribed on the inner surface of a translucent bubble to show only when the flashlight is turned on to light the bubble by pressing the bubble. These special features are not disclosed in the prior art.

DESCRIPTION OF MODES BEST EMBODYING THE INVENTION

Figure 5:
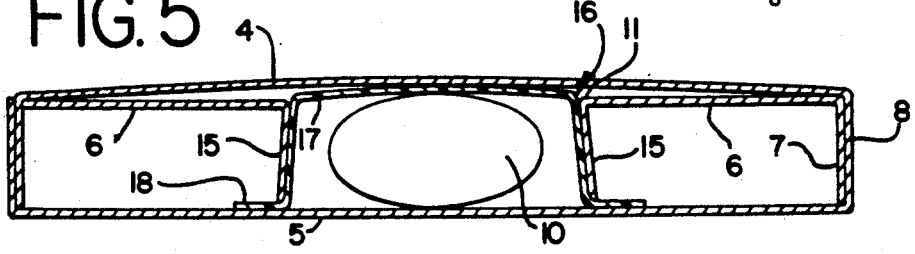
FIG. 5 is a cross-sectional view of the assembled package of the preceding figures containing a flashlight as the gift.
Figure 6:
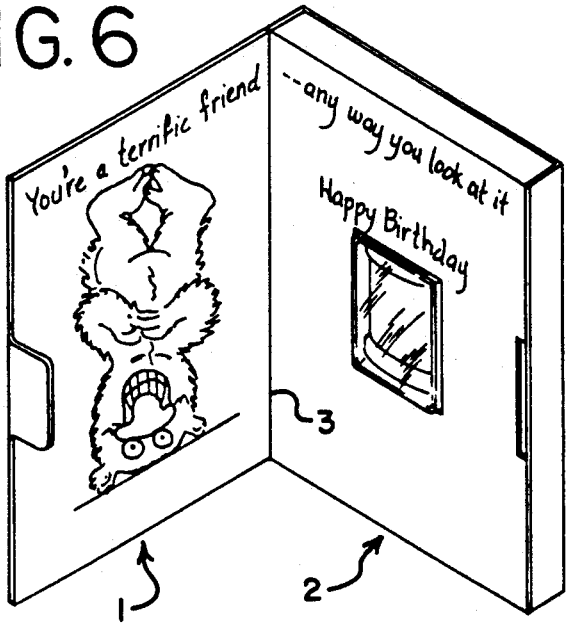
FIG. 6 is a perspective view of the assembled package.

The enclosed drawings illustrate two examples of applications of the invention. FIG. 6 is a perspective view of the example of the combined greeting card and gift package of FIGS. 1-5, part 1 being the greeting card and part 2 being the package but also a part of the greeting. Parts 1 and 2 are hinged together at 3, part 1 serving also as a cover of the package.

Figure 1:
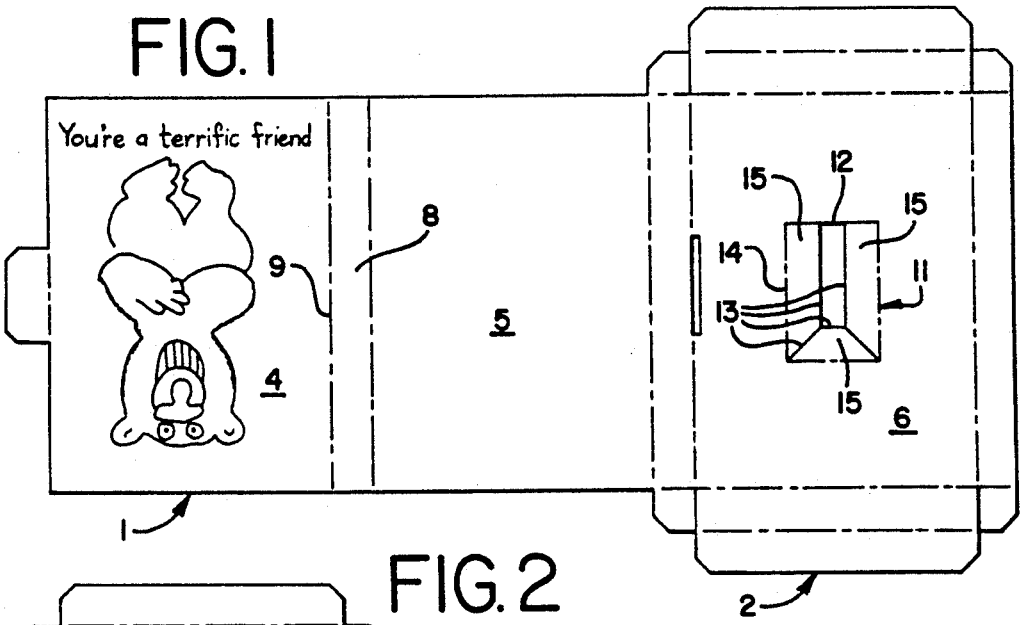
FIG. 1 is a plan view of the die cut and fold scored unitary blank which constitutes the combined greeting card and gift package of an exemplary embodiment of the invention.
Figure 2:
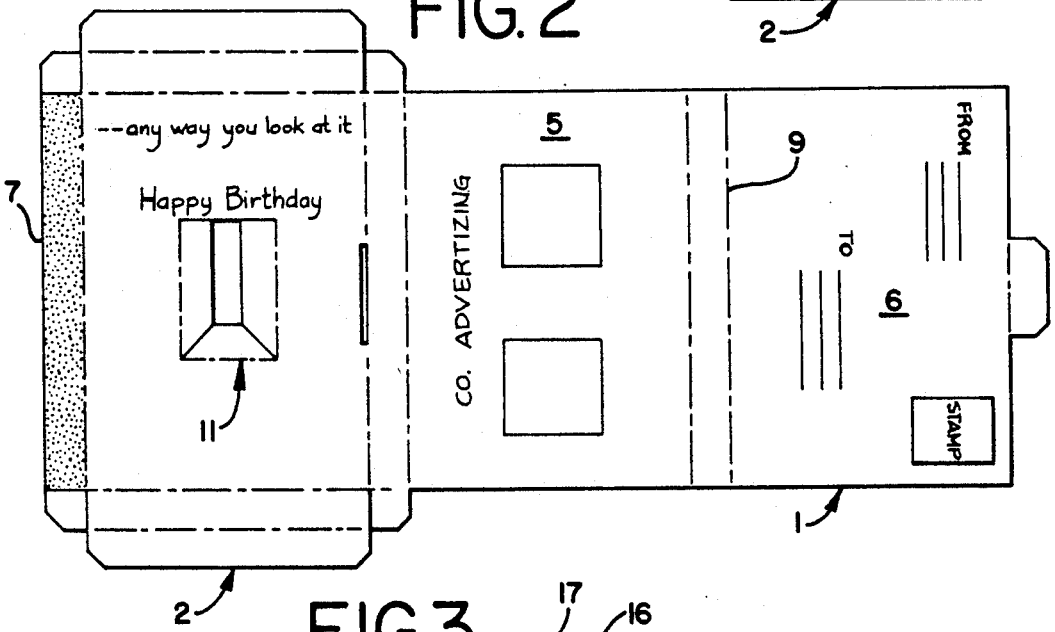
FIG. 2 is a plan view of the back side of the blank shown in FIG. 1.
Figure 3:
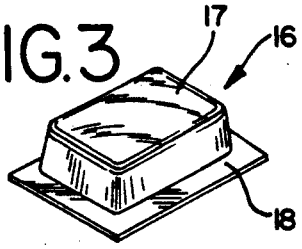
FIG. 3 is a perspective view of the transparent plastic gift holder.
Figure 4:
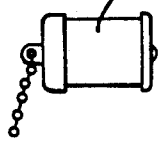
FIG. 4 is a front view of the flashlight which is the gift to be carried in the package.

As is seen in FIGS. 1 and 2, the entire package is made up from a single blank of appropriate paper which is cut to meet all requirements with score lines impressed for folding. Panel 4 is the cover of the unit, panel 5 is the back and panel 6, along with panel 5, forms the gift package. The necessary flaps are provided for use in assembling the unit. Flap 7 is to be glued to side 8, leaving the cover of part 1 free to hinge around fold line 9. The tabs extending from the top and the bottom of panel 6 eventually fold inwardly to close the gift container part.

To provide a holder for the flashlight 10, which is the gift to accompany the greeting, a rectangular opening is provided by cutting at line 12 and lines 13 so that flanges 15 may be folded inwardly along score lines 14. With this arrangement, a rectangular opening 11 is cleared through which the gift may be viewed and a frame comprised of flanges 15 are provided to hold the gift holder 16 in position.

A gift holder 16 of clear plastic material is thermoformed to form the bubble 17 having flanges 18. As is seen in FIG. 5, the gift holder 16 is arranged inside the gift container part with the flanges 18 abutting the back panel 5 and the face of the bubble 17 protruding through opening 11. Arranged in this way between the back panel 5 and the face 6 and flanges 15 of the gift panel, flanges 18 of the gift holder may be, but need not be, glued to back panel 5. Lateral movement of the holder cannot take place because of the sides of opening 11 which are engaged by the face portion of bubble 17.

In the example shown in FIGS. 1-6, a flashlight 10 is contained within holder 16. If desired, the flashlight may be employed as a novel feature of the greeting by printing the words "Happy Birthday" just above the line 12 as shown in FIG. 2 and arranging the flashlight with the lamp facing upwardly so that when activated by pressing on the flashlight the light will emphasize the printed greeting by back lighting the area on which the greeting is printed. It will be noted that with cut 12 there is no flange comparable to flanges 15 to interfere with the projection of the light from the flashlight in serving its purpose as described. If desired, the instructional word "PRESS" may be imprinted upon the face of bubble 17 so that the back lighting of the greeting may be activated by a person pressing the side of the battery through the flexible bubble.

As indicated in FIGS. 1, 2 and 6, any desired indicia may be printed on panel 4, panel 5 and panel 6.

Figure 9:
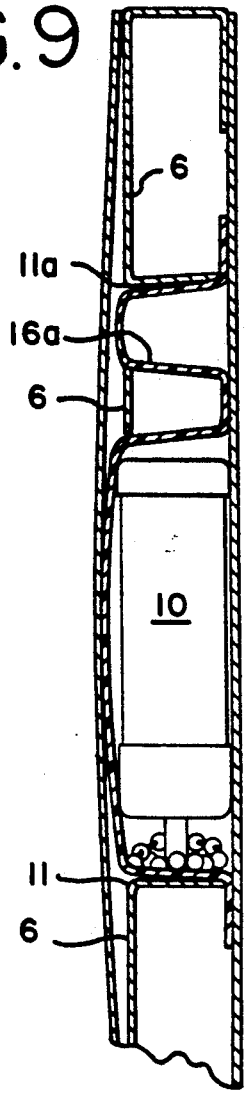
FIG. 9 is a cross-sectional view of the assembled modified form of package.
Figure 8:
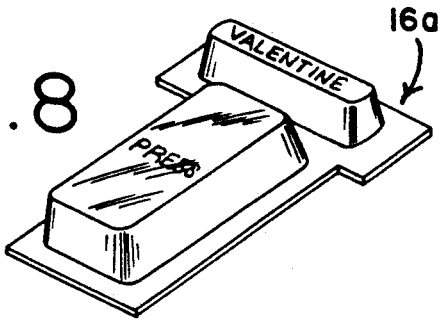
FIG. 8 is a perspective view of the plastic gift holder for the package assembled from the blank of FIG. 7.
Figure 7:
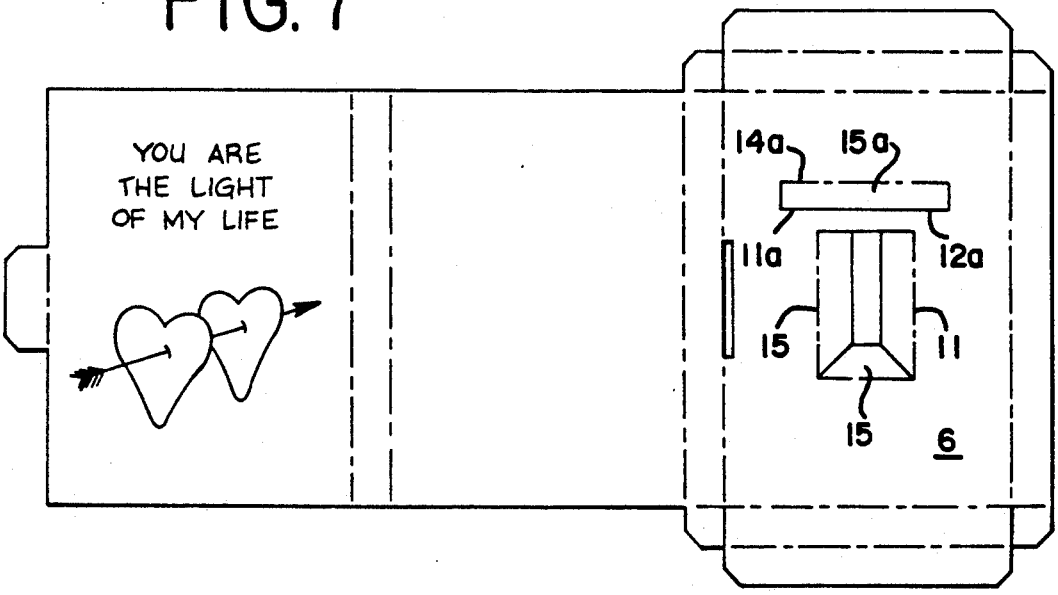
FIG. 7 is a plan view of the blank for a modified form of combined greeting card and gift package.

A modified form of the combined greeting card and gift package is illustrated in FIGS. 7, 8 and 9. In this embodiment of the invention, the structure of the combined unit is the same as that described with reference to FIGS. 1-6 with the single exception that a second opening **11*a* is provided in panel 6 just above opening 11. This is formed by cutting along the solid lines 12*a* shown and folding inwardly the flange 15*a* along the fold line 14*a*. The gift flashlight holder 16*a* shown in FIG. 8 includes a double bubble, each part of which protrudes through its respective opening in panel 6 as shown in FIG. 9. The instruction "PRESS" is printed upon the bubble which contains the gift flashlight and, in this example, the word "VALENTINE" is printed upon the face of the other bubble. By using, for example, a white translucent or opaque plastic film material for the holder 16***a* and printing the word "VALENTINE" on the inner surface of the bubble, it will light up and be seen only when the flashlight is activated by pressing on the face of the bubble containing it.

The invention lends itself to a wide variety of special designs adapted to the characteristics of the particular gift article and the nature of the greeting. That incorporated in the form of the invention illustrated in FIGS. 7-9 is an excellent example of a novel combined unit which provides not only a container for the gift but also contributes to the greeting message by highlighting the greeting when the gift flashlight is activated. It may be noted that the lighting system may be somewhat improved by designing the holder 16*a* with the two bubbles open to each other through a tunnel passageway (not shown) so that it is not necessary for the light to pass through the two thickness of the film. This may be particularly advantageous when a translucent or opaque film material is used.

In this invention the gift is beautifully displayed by reason of the curved perimeter of the bubble or bubbles which then serve as a kind of frame for the picture of the gift.

ACHIEVEMENT

The invention provides an attractive greeting card with which is combined a package for a gift flashlight as a part of the greeting and which may indeed enhance the greeting itself. It is an efficient and effective way to convey a greeting.

I claim:

1. In a combined greeting card and gift package formed from a single blank of paper and comprising two parts connected together at a center fold, the first of said parts being adapted to carry a message of greeting, the second of said parts comprising a package having a front and rear panels and adapted to contain a flashlight having a front side, the flashlight being activated by pressure applied to the front side; the improvements therein comprising a first window in said front panel of said package, said first window having a rectangular opening having first flanges depending from fold lines along the sides and bottom of said first window opening and extending to said rear panel of said package to form a frame for the flashlight, and a gift holder comprising a plastic bubble arranged within said frame and a second flange extending from said plastic bubble in engagement with said rear panel of said package, said bubble protruding through said first window, said second flange being located between said first flanges and said rear panel of said package.

2. The combined greeting card and gift package in accordance with claim 1 wherein said plastic bubble is transparent.

3. The combined greeting card and gift package in accordance with claim 1 or 2 wherein said front panel of said package also is adapted to carry a message of greeting.

4. The combined greeting card and gift package in accordance with claim 1 wherein a second window is provided in said front panel of said package in spaced relation to said first window and wherein said gift holder comprises two plastic bubbles spaced apart and each protruding through a respective one of said two windows.

5. The combined greeting card and gift package in accordance with claim 1, 2 or 4 wherein one of said plastic bubbles carries indicia upon the protruding surface thereof.

6. The combined greeting card and gift package in accordance with claim 1 including a second window provided in said front panel of said package in spaced relation to said first window and wherein said gift holder comprises two plastic bubbles spaced apart and each protruding through a respective one of said two windows, said plastic bubbles being translucent, and indicia upon the inner surface of said plastic bubble protruding through said second window whereby said indicia is made to appear when said flashlight is activated to light the interior of said plastic bubble carrying said indicia.

7. A combined greeting card and gift package formed from a single blank of paper and comprising two parts connected together at a center fold, the first of said parts being adapted to carry a message of greeting, the second of said parts having front and rear panels and adapted to contain a flashlight activated by pressure applied to the flashlight; the improvements therein comprising a first window and a second window in said front panel of said package, said first window being in spaced relation to said second window and having a rectangular opening having first flanges depending from fold lines along the sides and bottom of said first window opening and extending to said rear panel of said package to form a frame for the flashlight, and a gift holder comprising a first plastic bubble, a second plastic bubble spaced apart from said first plastic bubble and a second flange extending from said first plastic bubble, said plastic bubbles being translucent, said first plastic bubble arranged within said frame such that said second flange is in engagement with said rear panel of said package and such that said first plastic bubbles protrudes through said first window, said second plastic bubble protruding through said second window, and indicia upon the inner surface of said second plastic bubble whereby said indicia is made to appear when said flashlight is activated to light the interior of said second plastic bubble.

* * * * *